US005830002A

United States Patent [19]

Ito et al.

[11] Patent Number: 5,830,002

[45] Date of Patent: Nov. 3, 1998

[54] CONNECTOR

[75] Inventors: Osamu Ito; Toshikazu Saba, both of Yokkaichi, Japan

[73] Assignee: Sumitomo Wiring Systems, Ltd., Japan

[21] Appl. No.: 693,597

[22] Filed: Aug. 5, 1996

[30] Foreign Application Priority Data

| | | | |
|---|---|---|---|
| Aug. 3, 1995 | [JP] | Japan | 7-219698 |
| Aug. 7, 1995 | [JP] | Japan | 7-222660 |
| Aug. 8, 1995 | [JP] | Japan | 7-224734 |

[51] Int. Cl.[6] ..... H01R 13/627

[52] U.S. Cl. ..... 439/358

[58] Field of Search ..... 439/350, 357, 439/358, 488

[56] References Cited

U.S. PATENT DOCUMENTS

| | | | |
|---|---|---|---|
| 4,944,693 | 7/1990 | Puerner | 439/358 |
| 5,382,177 | 1/1995 | Hutchinson, Jr. et al. | 439/358 |

FOREIGN PATENT DOCUMENTS

| | | |
|---|---|---|
| 2-95174 | 7/1990 | Japan . |
| 3-196478 | 8/1991 | Japan . |

*Primary Examiner*—Khiem Nguyen
*Assistant Examiner*—Yong Kim
*Attorney, Agent, or Firm*—Banner & Witcoff, Ltd.

[57] ABSTRACT

A connector assembly (10,30;120,140;210,230) comprises a female connector and a male connector for insertion in the female connector. A latching arm (20,130,220) is provided on one of the female and male connectors, and a latching abutment (33,143,233) is provided on the other of the female and male connectors. Insertion resistance means (24,34;133, 42;226,233) are effective only in the insertion direction to increase the latching force.

21 Claims, 19 Drawing Sheets

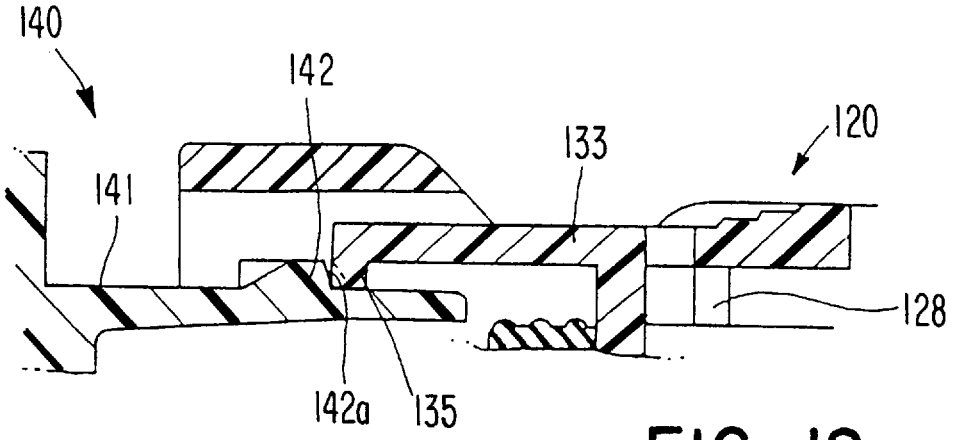
FIG. 12
FIG. 13
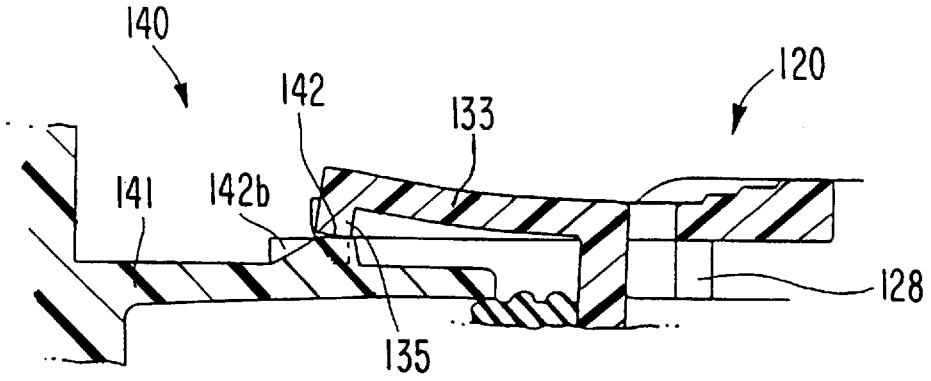

CONNECTOR

TECHNICAL FIELD

The present invention relates to electrical connectors that are retained in a locked state by means of a locking arm.

BACKGROUND TO THE INVENTION

FIGS. 30 and 31 show a conventional electrical connector assembly having male and female parts. A female connector 1 comprises an angular tube-shaped terminal insertion member 3 into which a female terminal 2 is inserted. This terminal insertion member 3 is inserted into a housing 6 that surrounds a male terminal 5 of a corresponding male connector 4. The upper face of the terminal insertion member 3 has a locking arm 8 that is supported by means of a foot 7. The locking arm 8 is movable in the directions indicated by a curved bidirectional arrow 10, with the foot 7 as fulcrum.

A fitting projection 9 is arranged to project from the upper face of the housing 6 of the male connector 4. When the terminal insertion member 3 of the female connector 1 is inserted into the housing 6 of the male connector 4, the anterior end of the locking arm 8 makes contact with a contact face 9*a* of the fitting projection 9 (see FIG. 30). Upon pushing the terminal insertion member 3 more strongly into the housing 6, the locking arm 8 changes position resiliently and bends so as to mount the fitting projection 9 (see FIG. 31). Then the locking arm 8 crosses over the fitting projection 9 and reverts to its original position. Due to this movement the locking arm 8 and the fitting face 9*b* of the fitting projection 9 mutually fit closely with each other and the connectors 1 and 4 are latched together with the male and female terminals 2 and 5 in a connected state. In order to release this locked state, the rearmost end of the locking arm 8 is pressed down with a finger thereby separating from the fitting projection 9 and permitting the connectors to be drawn apart. Such a connector assembly is well-known.

However, with the above configuration, if a better fit is to be achieved by increasing the insertion resistance that results from the locking arm 8 crossing over the fitting projection 9, a problem occurs in that it becomes difficult to carry out the removal operation necessary to release the locking arm 8 from its fitted state.

The reason for the foregoing problem is the following. The insertion resistance is a function of lever arm length L shown in FIG. 30, between the foot 7 and the anterior end of the locking arm 8. By making the lever arm shorter the insertion resistance will be increased. This results in the position of the foot 7 being set more towards the anterior of the terminal insertion member 3 than is shown in FIG. 30 and as a result the length of the arm from the foot 7 to the posterior end can be increased so as to provide the extra leverage necessary to release the locking arm 8. However the downward displacement of the posterior end is restricted by the body of the connector, and if the release arm is made shorter the release force inevitably increases.

Moreover, with the above conventional configuration, in order to deal with, for example, the increase in terminal fitting resistance accompanying the multi-terminalization of connectors, if the insertion resistance that occurs when the locking arm 8 crosses over the fitting projection 9 is increased, there is another problem in that it becomes difficult to carry out the removal operation for releasing the locking arm 8 from its fitted state.

The reason for that problem is the following. In order to set the insertion resistance to be high, one way is to increase the height of the fitting projection 9. With the above configuration, however, upon releasing the lock the locking arm 8 must return along the path it took during the fitting. For this reason, during the locking release operation it becomes necessary to make the anterior end of the locking arm 8 move to a large extent in order to cross over the high fitting projection 9, and a strong force becomes necessary for this operation, making the locking release operation difficult. Consequently, in the conventional connector, it is not possible to have both a close fit and an easy locking release operation.

Further, a so-called inertia lock can, for example, be used in the case where it is desirable that the close fit of the connectors is strengthened. The inertia lock is achieved by setting the insertion resistance, which takes effect when the locking arm 8 crosses over the fitting projection 9, to be greater than the fitting resistance that accompanies the fitting of the male and female terminals 2 and 5. If, on the other hand, the insertion resistance is set to be less than the fitting resistance, it is possible that the insertion operation ends up with the two terminals 2 and 5 in a half-fitted state. However, if the setting is carried out as described above, and if the insertion of the connector is carried out until a click accompanying the fitting-in is heard, the insertion of the connector being accompanied by the locking arm 8 crossing over the fitting projection 9 while continuously receiving the resistance of the fitting projection 9, then one can be certain that the terminals 2 and 5 will reach a completely fitted state. According to this, a superior effect can be achieved in that the occurrence of partial fitting during the assembly line of the device can be prevented from the very outset.

Furthermore, in order to increase the closeness of fit, technology such as that described in Japanese Laid Open Publication HEI2-95174 also has been presented. As shown in FIG. 32, this has a configuration so that arms 112, for applying resistance during fitting in addition to the resistance provided by locking arms 111 provided for stopping, are provided with a common foot member 113.

However, if the closeness of fit is attempted to be increased by increasing the fitting resistance, it becomes necessary to increase the strength of the common foot member 113 by making it thicker. However, since the base member 111 of the locking arm and the arm 112 for applying resistance are formed uniformly on the connector housing 114 via a common foot member 113, not only does the elasticity of the locking arm 111 deteriorate, but the locking release operation also becomes difficult if the strength of the common foot member 113 is increased in order to improve the closeness of fit.

Accordingly the aim of the invention is to increase the insertion force so as to ensure full engagement of the terminals, whilst permitting easy disengagement of the locking arm.

The present invention has been developed taking the above circumstances into account. The aim of the present invention is to present connectors wherein the locking release operation can be carried out with ease, while at the same allowing a close fit.

According to the invention there is provided a connector assembly comprising a female connector and a male connector for insertion in said female connector, wherein one of the male and female connectors has a latching arm and the other of the male and female connectors has a latching abutment for engagement by the latching arm, the latching arm and latching abutment having a latching force, and the latching arm engaging the latching abutment to releasably retain the male connector in the female connector, the assembly further including insertion resistance means on the male and female connectors, in use the insertion resistance means being effective only in the insertion direction to increase said latching force.

Other features of the invention will be apparent from the accompanying description of several preferred embodiments described by way of example only with reference to the accompanying drawings in which:

FIG. 12 is a partial vertical cross-section of the second embodiment showing a resilient arm making contact with an abutment.

FIG. 13 is similar to FIG. 12 and shows the elastic arm crossing over the abutment.

The first embodiment of the present invention is explained hereinbelow, with reference to FIGS. 1 to 9.

Figure 1:
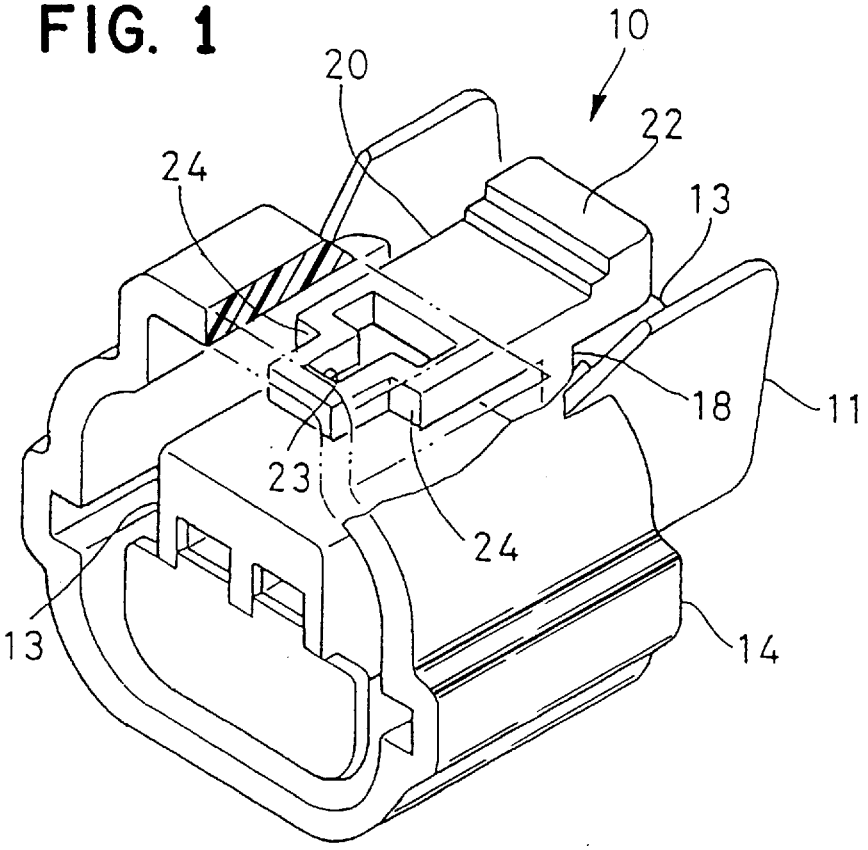
FIG. 1 is a diagonal view of a female connector representing a first embodiment of the present invention.
Figure 2:
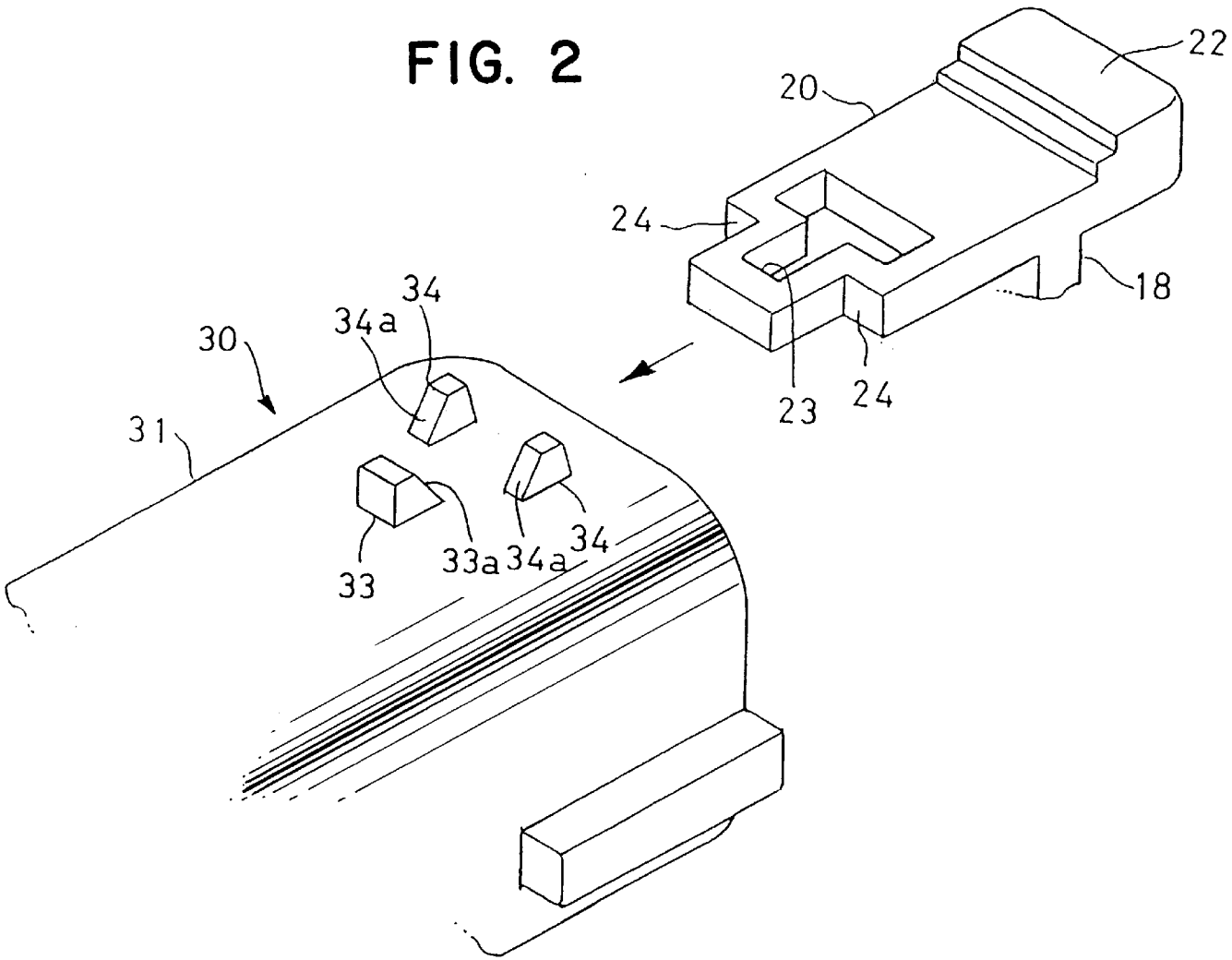
FIG. 2 is a diagonal partial view of a locking arm and female connector of the first embodiment.

A female connector 10 of the present embodiment is shown in FIG. 1. A connector housing 11 made from synthetic resin comprises a terminal insertion member 13 that allows the insertion of female terminal fittings 12 therein, and a hood member 14 that covers and almost completely surrounds the anterior half of the terminal insertion member 13. The terminal insertion member 13 forms an angular tube-like shape. The hood member 14 also has an angular tube-like shape, with slightly curved corners. An annular fitting space is provided between the hood member 14 and the outer circumference of the terminal insertion member 13 for the insertion of a corresponding male connector 30. (FIG. 3).

The female terminal fitting 12 is prevented from being removed from the terminal insertion member 13 by the usual lance 13*a* provided on the terminal insertion member 13, and is doubly stopped by means of a retainer 13*b*. Such a construction is conventional. Moreover, a sealing ring 13*c* is fitted on the outer periphery of the terminal insertion member 13.

Figure 3:
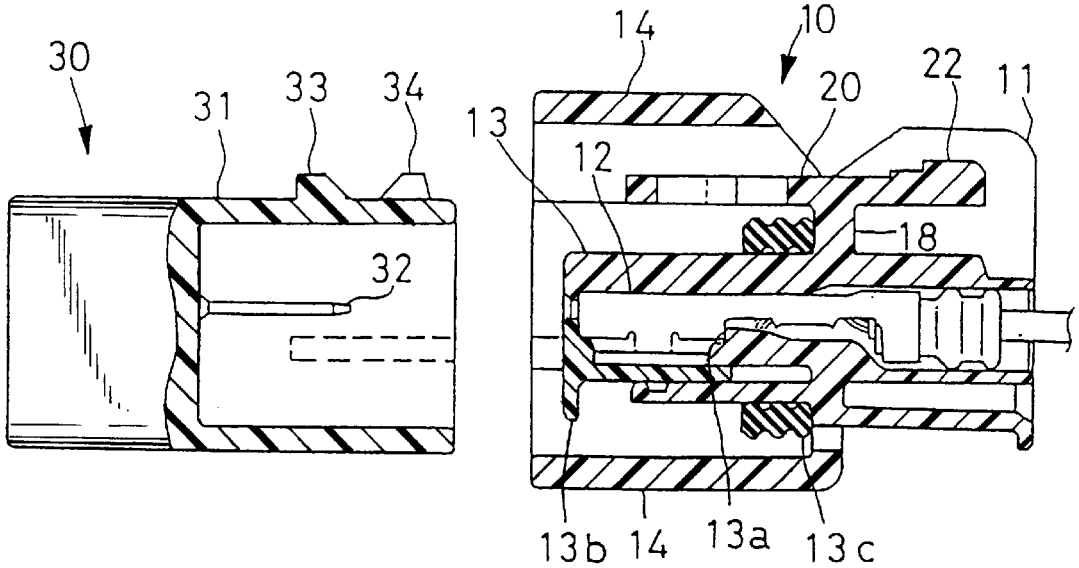
FIG. 3 is a vertical cross-section through a male and female connector according to the first embodiment.
Figure 4:
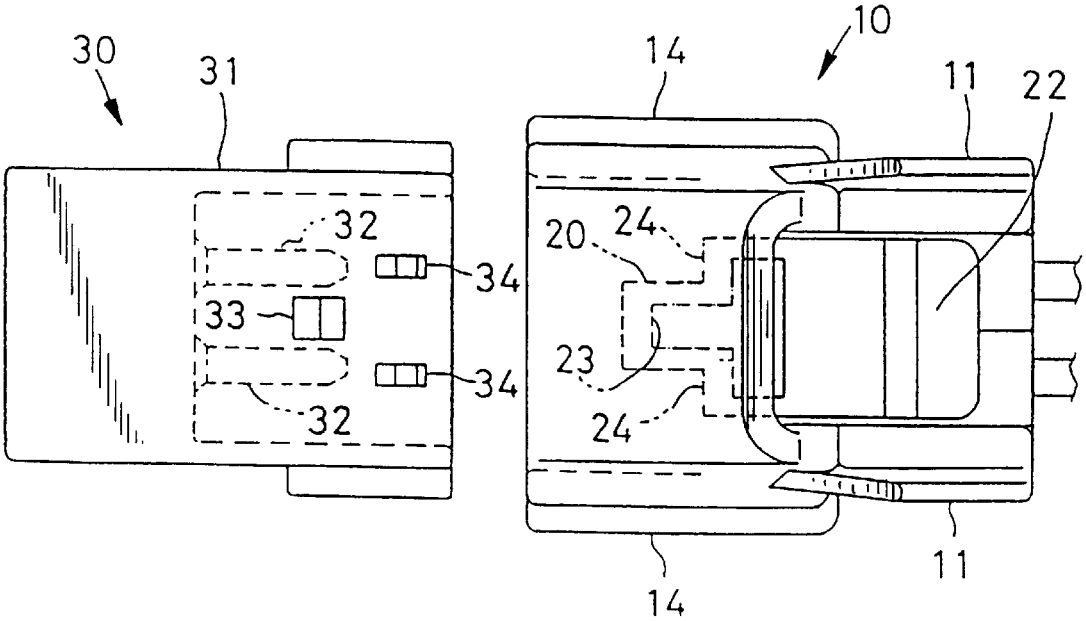
FIG. 4 is a plan of the male and female connector according to the first embodiment.
Figure 5:
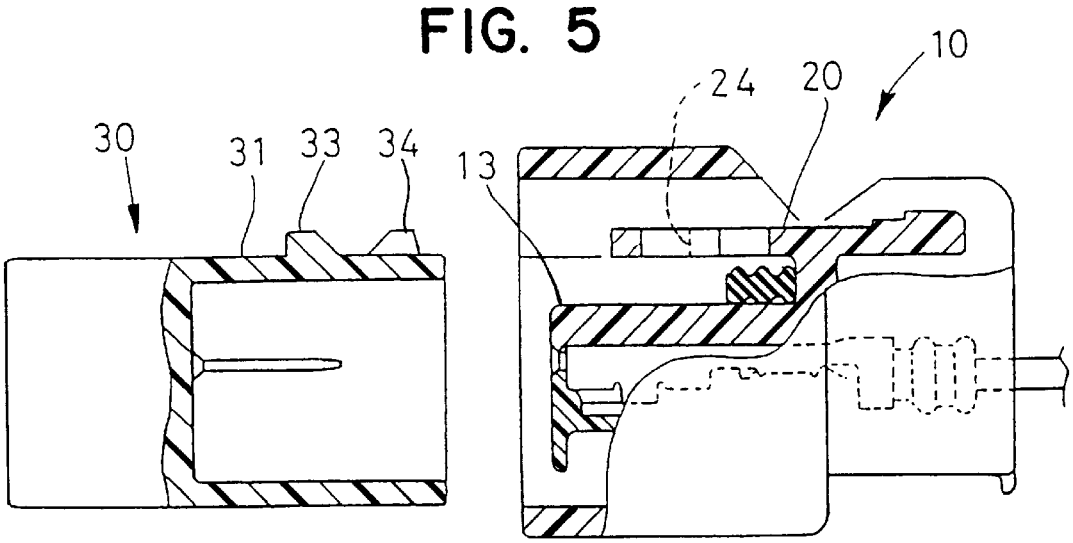
FIG. 5 is a vertical cross-section of a male and female connector according to the first embodiment.
Figure 6:
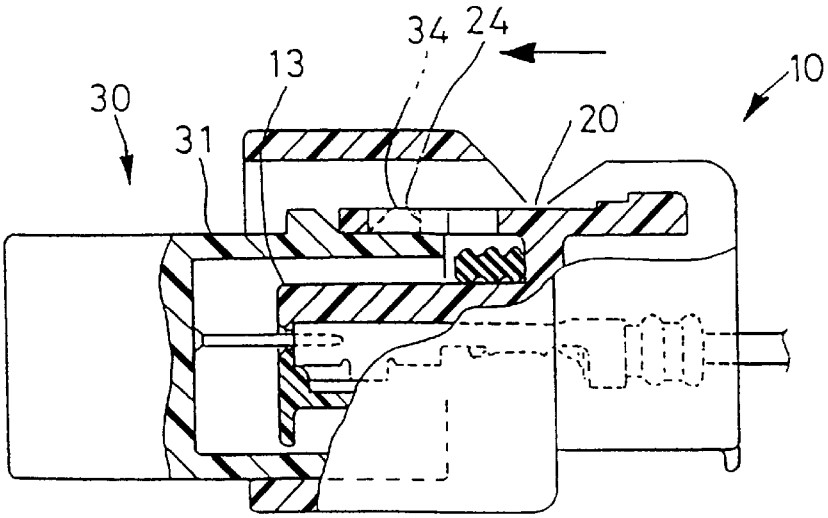
FIG. 6 is a vertical cross-section showing the fitting process of the first embodiment.
Figure 7:
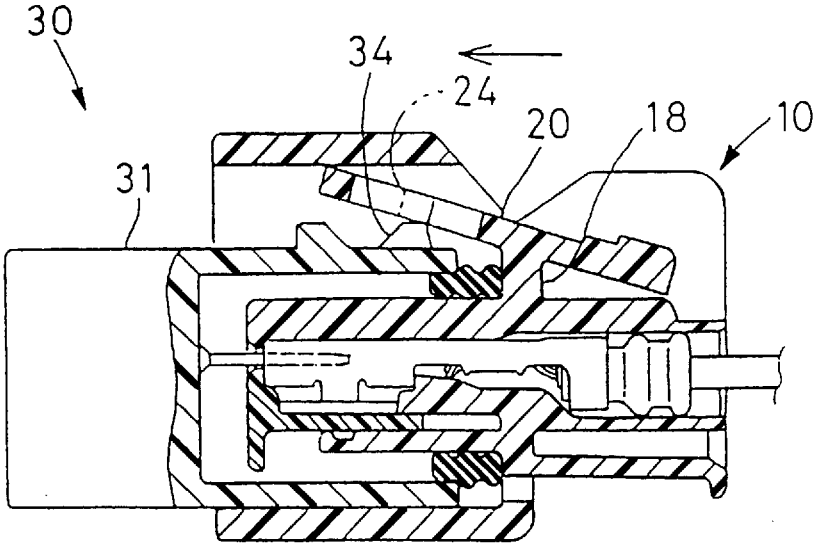
FIG. 7 is a vertical cross-section showing the fitting process of the first embodiment.

As shown in FIG. 3, a corresponding male connector 30 has a tubular connector housing 31 that projects in an anterior direction. A male terminal fitting 32 projects within the connector housing 31. The male connector 30 is guided and inserted into the inner periphery of the hood member 14 of the female connector 10. When the connectors 10 and 30 are correctly fitted together, the female terminal fitting 12 and the male terminal fitting 32 are electrically connected and are latched in a fitted state by means of a locking means, to be described next.

A stopping projection 33 projects from approximately the centre of the upper face of the connector housing 31 of the male connector 30. This projection 33 has an inclined face 33*a* on the side facing the female connector 10 and the opposite side thereof is approximately perpendicular, as viewed (FIG. 1). Furthermore, two identical abutments 34 project at either side and closer to the front edge of the connector than the projection 33.

These abutments 34 have an almost perpendicular face on the side facing the female connector 10 which are thus located opposite to that of the perpendicular face of the stopping projection 33. A inclined face 34*a* is formed on the other sides of the projections 34. The projection 33 is located approximately in the centre of the connector housing 31, and the two abutments 34 are symmetrically placed on either side thereof.

A T-shaped locking arm 20 is uniformly formed on the upper face of the female connector 10 and has a resilient supporting foot 18. An anti-slipping pressing member 22 is formed at the posterior end thereof. Depression of this pressing member 22 causes the anterior end to rise upwards with the foot 18 as fulcrum.

The anterior end of the locking arm 20 is generally planar. In the centre is formed a fitting hole 23 which fits in use with the projection 33. A contact face 24 is formed on each side of the fitting hole 23 and to the rear thereof for contact with the abutments 34.

Figure 8:
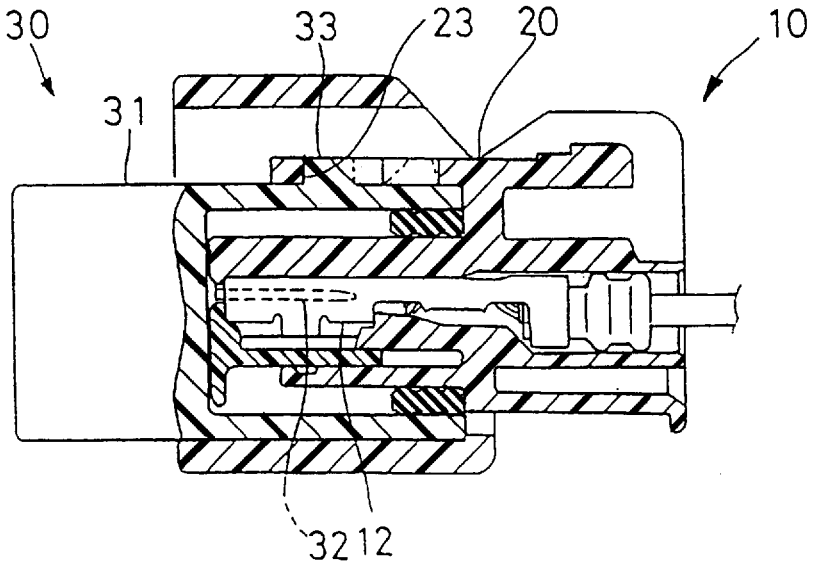
FIG. 8 is a vertical cross-section showing the fitted state of the first embodiment.

Operation of the embodiment is now explained. When the female connector 10 is fitted with the male connector 30, the terminal insertion member 13 enters the connector housing 31 of the male connector 30, and first the contact members 24 of the locking arm 20 strike against the abutments 34 (see FIG. 6). At this stage, there is a large insertion resistance since the adjacent face of the abutments 34 is almost vertical. When the female connector 10 is pushed even more strongly against the insertion resistance, the locking arm 20 changes position resiliently so that the contact members 24 cross over the abutments 34 (see FIG. 7). In this way, the fitting resistance is relatively large, this resistance being produced because the contact member 24 is provided at a location that is relatively close to the foot 18 and thus the lever arm is small. As the female connector 10 is pressed in further, the contact members 24 completely cross over the abutments 34. The moment this happens, the anterior end of the locking arm 20 moves downwards due to the inherent resilience, and as a result, strikes against the upper face of the connector housing 31 of the male connector 30, and makes a clicking sound. A close fit is achieved due to the high engagement force. As the contact members 24 cross over the abutments 34, the connectors reach a latched state as shown in FIG. 8, and the stopping hole of the locking arm 20 fits with the projection 33. Moreover, when the connectors 10 and 30 are in the latched state, the male terminal fitting 32 is inserted completely in the female terminal fitting 12, resulting in a correctly fitted connection.

When the connectors 10 and 30 are to be separated, the pressing member 22 of the locking arm 20 is pressed down using a finger or thumb. When this is done, the locking arm 20 changes position with the foot 18 as fulcrum so that the anterior end thereof rises upwards. The fitting hole 23 separates from the stopping projection 33, and the lock is released. At this juncture, the female connector 10 may be separated from the male connector 30.

In this way, according to the present embodiment, when the connectors 10 and 30 are connected, a large elastic resistance is produced since the contact member 24 is located at a relatively short distance from the supporting foot 18. This results in a firm closeness of fit being achieved. Consequently, even in the case of a multiple-terminal connector in which a large resistance is produced due to the fitting of the individual terminals, a closeness of fit that surpasses the fitting resistance is achieved. As a result, the connector fitting operation is a so-called inertia lock.

Figure 9:
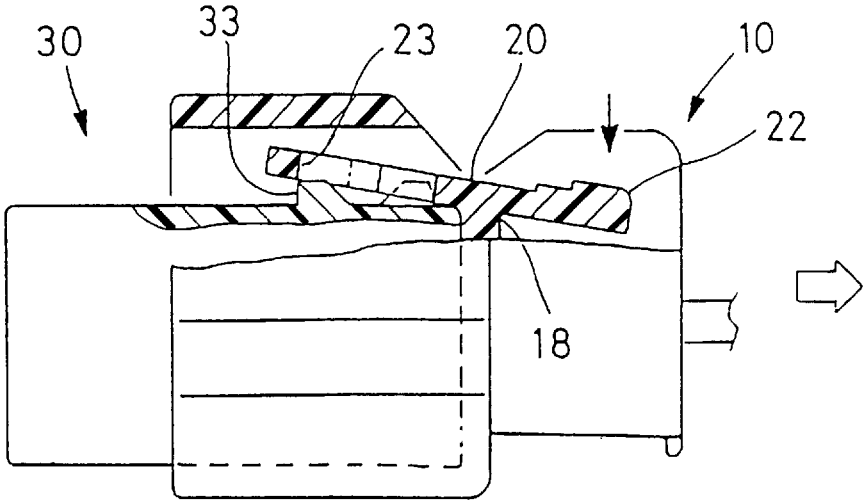
FIG. 9 is a vertical cross-section showing the separation process of the first embodiment.

Moreover, the release operation becomes easier. This is because the fitting hole 23 of the locking arm 20 is located in a position that is at a greater distance with respect to the foot 18 than the contact member 24 and as a result the pressing member 22 needs to be pressed only slightly in order to bend the locking arm 20 resiliently to the release condition (FIG. 9).

Furthermore, and particularly in the present embodiment, since the contact members 23 have been located on both sides of the fitting hole 23, when the contact members 24 of the locking arm 20 make contact with the abutments 34, a balanced resistance is ensured, thus preventing sideways movement of the locking arm 20.

Figure 10:
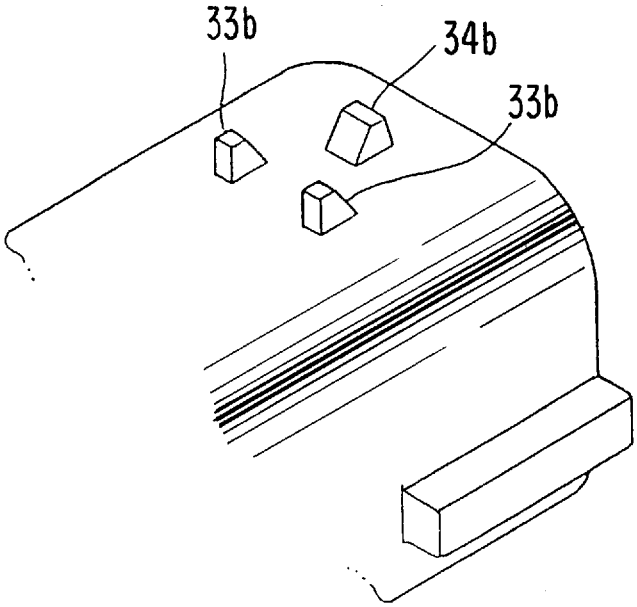
FIG. 10 is a diagonal view illustrating the abutments of an embodiment of the invention.

FIG. 10 illustrates an alternative embodiment with a single abutment 33*b* on either side of two latching projections 33*a*. The latching arm is adapted accordingly.

The second embodiment of the present invention is explained hereinbelow, with reference to FIGS. 11 to 16.

Figure 11:
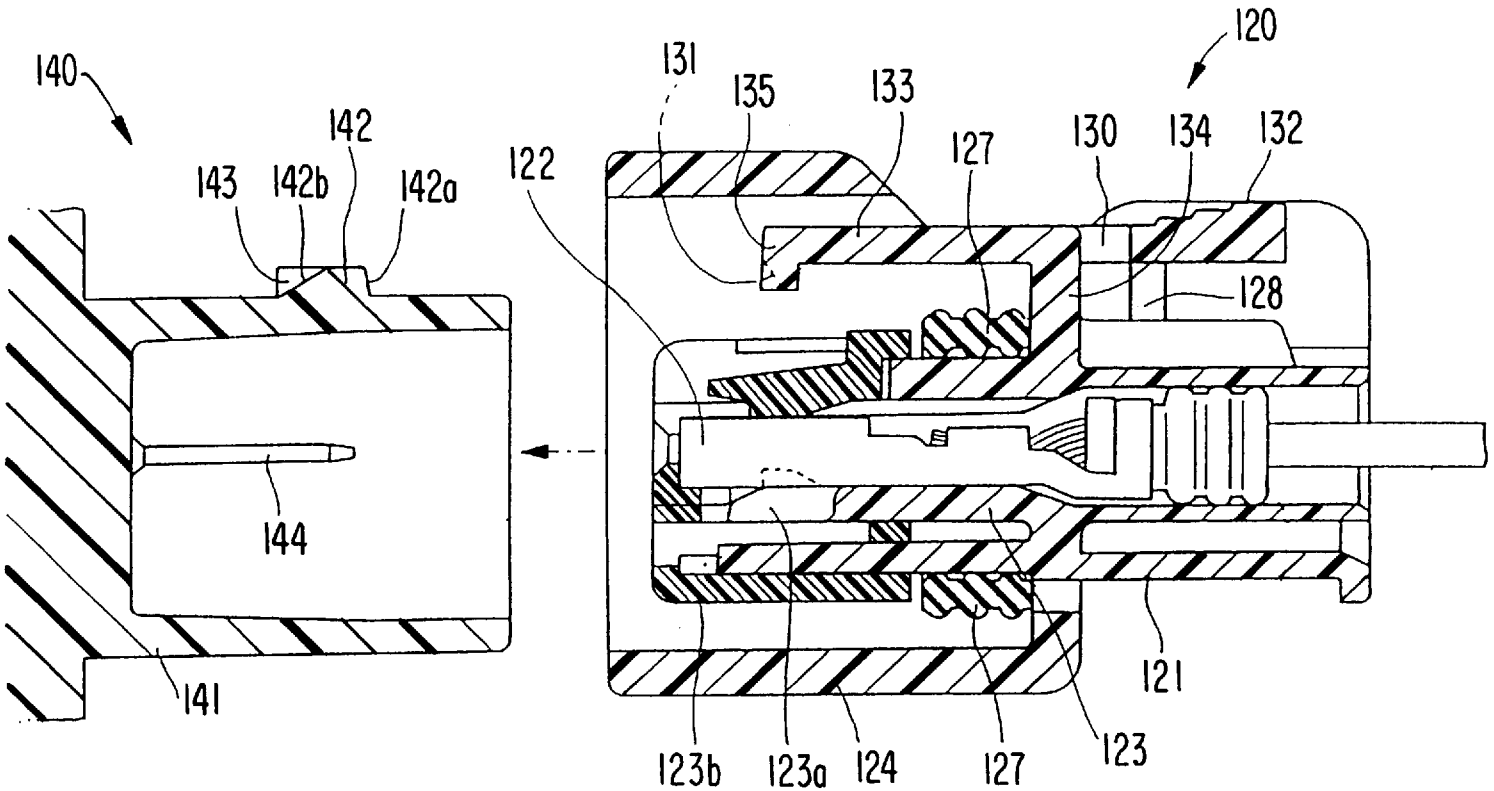
FIG. 11 is a vertical cross-section through connectors constituting a second embodiment of the present invention.
Figure 14:
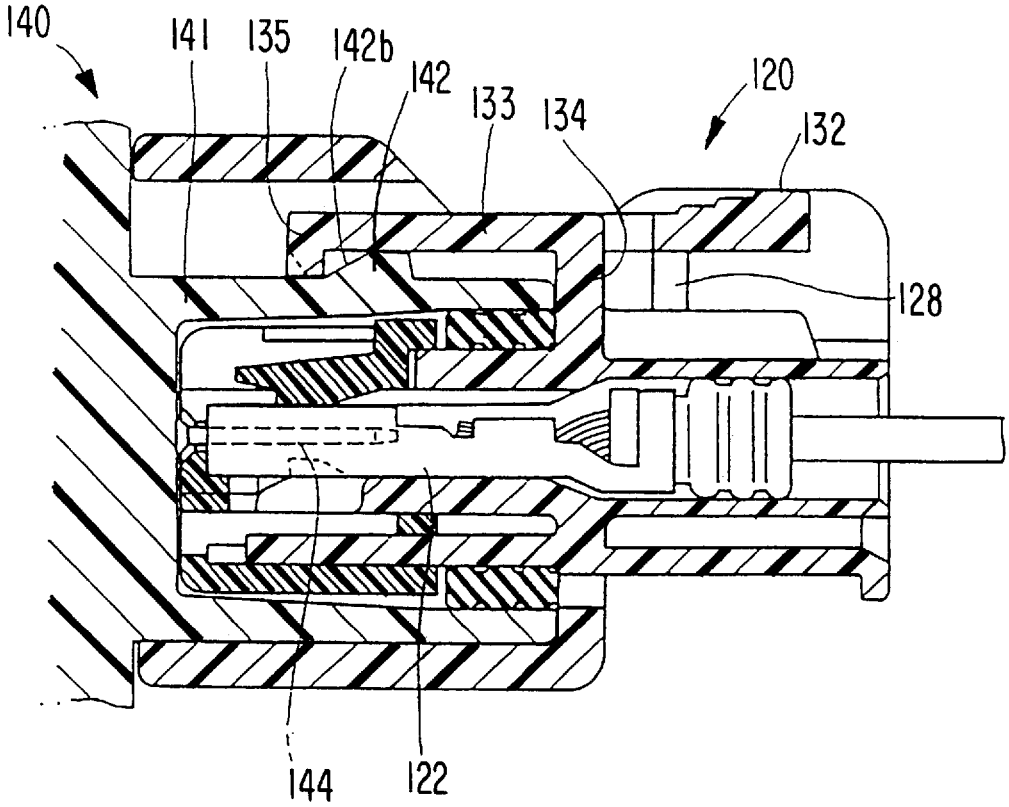
FIG. 14 is a vertical cross-section of the second embodiment of the present invention showing the male and female connectors in a fitted state.

A female connector 120 of the present embodiment is shown on the right side in FIG. 11. As for the first embodiment, a connector housing 121 is made from synthetic resin and has a terminal insertion member 123, female terminal fittings 122 therein, and a hood member 124 to receive a corresponding male connector 140.

The female terminal fitting 122 is retained by means of a lance 123*a* and retainer 123*b*.

As shown on the left of FIG. 11, a corresponding male connector 140 has a tubular connector housing 141 with a male terminal fitting 144. When the connectors 120 and 140 are correctly fitted together, the female terminal fitting 122 and the male terminal fitting 144 are electrically connected and are latched in a fitted state by means of a locking means, to be described next.

An abutment 142 projects from approximately the centre of the upper face of the male connector 140. Two fitting projections 143 are provided, one on each side of the abutment 142 which has an almost perpendicular face 142*a* on the side facing the female connector 120, and a gently inclined, resistance reducing face 142*b* on the other side. Each fitting projection 143 has an inclined face 143*a* on the side facing the female connector housing 120, and the opposite side thereof is approximately perpendicular.

Two locking arms 130 are provided spaced apart on two resilient supporting feet 128 on the upper face of the female connector 120. The locking arms 130 are aligned to face the anterior end of the connector housing 121. At the anterior end of each locking arm 130 is provided a locking claw 131 that faces downwards. The anterior face of each locking claw 131 is inclined so as to correspond with the inclined face 143*a* of the respective fitting projection 143. Moreover, the posterior side of each locking arm 130 is formed uniformly with the foot 128 and has a pressing member 132 that is shaped so as to prevent slipping. Depression of this pressing member 132 causes the locking claw 131 at the anterior end to rise upwardly with the foot 128 as fulcrum.

Figure 16:
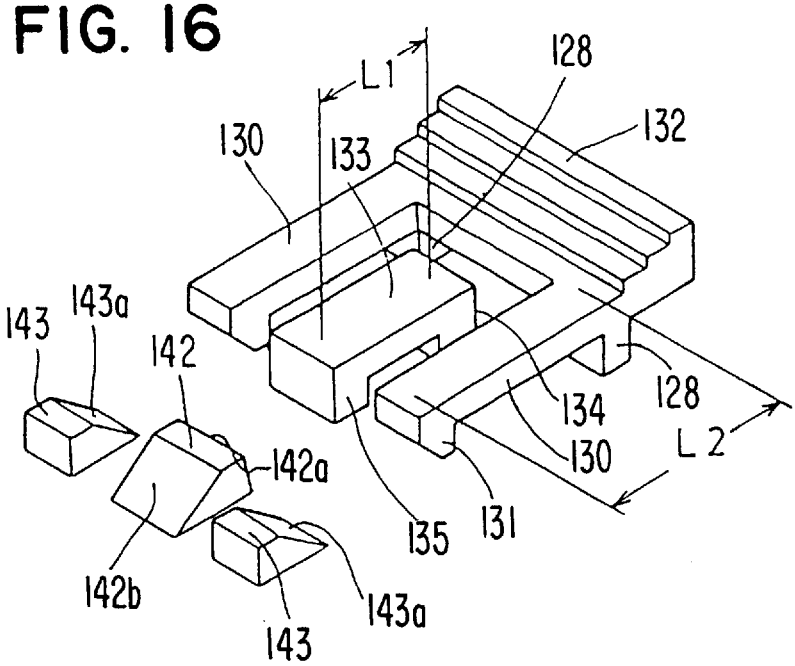
FIG. 16 is a partial diagonal view of the second embodiment of the present invention showing the latching arm and abutments.

As shown in FIG. 16, resilient arm 133 projects from between the locking arms 130. The arm 133 is formed uniformly with the connector housing 121 via a supporting foot 134, in the same way as the locking arms 130. The anterior end of the arm 133 has a contact member 135 that projects downwardly approximately perpendicularly and is arranged to be level with the locking claws 131. However, since the foot 134 of the arm 133 is located closer to the anterior end of the connector housing 121 than the foot 128 of the locking arm 30, the length L1 of the arm 133 is less than the length L2 of the locking arm 130.

Operation of the second embodiment is now explained. When the female connector 120 is fitted with the male connector 140, the terminal insertion member 123 enters the connector housing 141 of the male connector 140, and when fitting is half-complete, the contact member 135 of the elastic arm 133 strikes against the adjacent face 142*a* of the abutment 142 (see FIG. 12). Since the face 142*a* of the collision-preventing projection 142 is almost vertical, the arm 133 changes shape resiliently. When the female connector 120 is pushed even more strongly, the arm 133 changes shape resiliently so that the contact member 135 rides over the collision-preventing projection 142 (see FIG. 13). In this way, the resilient force produced when the elastic arm 133 rides over the collision-preventing projection 142 is relatively large since the arm length L1 of the arm 133 is relatively short. As a result, there is a large fitting resistance.

When the female connector 120 is pressed in further, the contact member 135 moves over the resistance reducing face 142*b*, thereby reducing the fitting resistance rapidly and causing the female connector 120 to be pulled into the male connector 140. Accordingly, the fitting operation results in a close fit.

Figure 15:
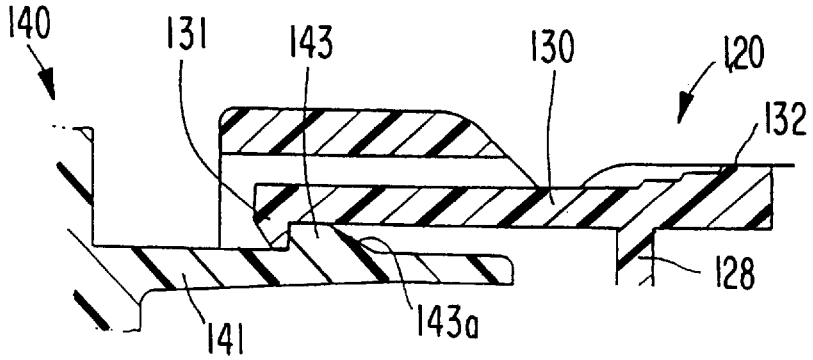
FIG. 15 is a partial vertical cross-section of the second embodiment showing engagement of the latching arm.

Furthermore, at the same time as the arm 133 crosses over the abutment 142, each locking claw 131 makes contact with a respective inclined face 143*a*. Consequently, the locking arm 130 changes shape by being guided over and eventually riding over the fitting projection 143. Since the other face 143*b* of the fitting projection 143 is shaped so as to be almost vertical, the moment the locking arm 130 crosses over the fitting projection 143, the locking claw 131 collides against the upper face of the female connector housing 141 of the male connector 140 with a clicking sound due to the resilience of the locking arm 130. Accordingly, as shown in FIG. 15, both the connectors reach a latched condition with the male terminal fitting 144 inserted completely into the female terminal fitting 122. (See FIG. 14).

When the connectors 120 and 140 are to be separated, the pressing member 132 of the locking arm 130 is pressed down using a finger or thumb. When this is done, the locking arm 130 changes shape with the foot 128 as fulcrum so that the locking claw 131 rises upwards and the fitting with the fitting projection 143 is released. At this juncture, if the female connector 120 is pulled away from the male connector 140, the female connector 120 is released from the connector housing 141 of the male housing 140. Here, the contact member 135 of the elastic arm 133 interferes with the abutment 142. However, since the face of the collision-preventing projection 142 facing towards the fitting direction is the gently inclined resistance reducing face 142*b*, a large resistance is not produced when the contact member 135 crosses over the collision-preventing projection 142. This allows an easy release of the fitting.

In that way, according to the second embodiment, the connectors 120 and 140 are connected with a large fitting resistance. This results in a close fit. A large resistance force is produced since the arm 133 is set to have a shorter arm length L1 than that of the locking arm 130. Consequently, even in the case of a multiple-terminal connector in which a large resistance is produced due to the fitting connection between terminal fittings, a connector fitting operation that operates as a so-called inertia lock is ensured.

Moreover, the release operation becomes relatively easy. This is because a large resistance is not produced even if the elastic arm 133 interferes with the abutment 142 in the removal direction of the connector. This allows a superior effect to be achieved in that both a reliable closeness of fit and an easy release of the fitting can be achieved.

Furthermore, and particularly in the second embodiment, since the two locking arms 130 are arranged to form a pair along the fitting direction, and the arm 133 is located between the pair of locking arms 130, the locking arms 130 and the elastic arm 133 are aligned in proximity to one another. As a result, an advantage is achieved in that the connectors have a more compact configuration, overall.

Moreover, the second embodiment is advantageous in that the abutment 142 is provided along the direction of movement of the arm 133.

Various different configurations of the second embodiment are illustrated in FIGS. 17–20.

Figure 17:
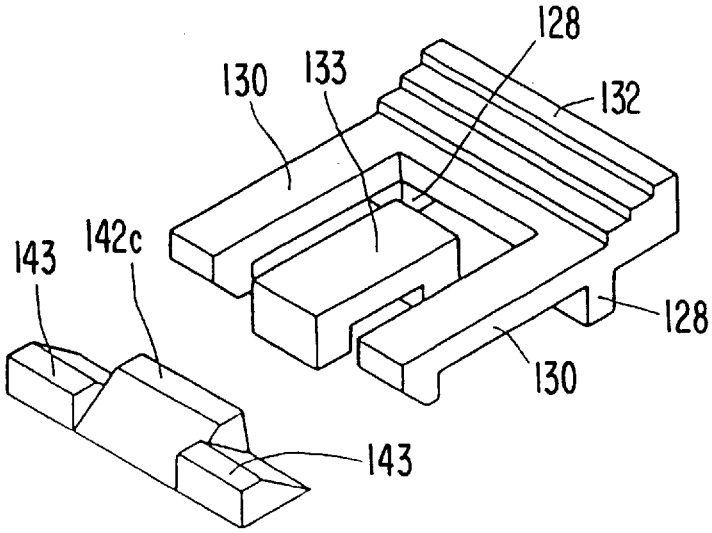
FIG. 17 is similar to FIG. 16 but shows an alternative arrangement.

FIG. 17 shows a wide abutment 142*a* which ensures that the arms 130 and 133 are correctly guided.

Figure 18:
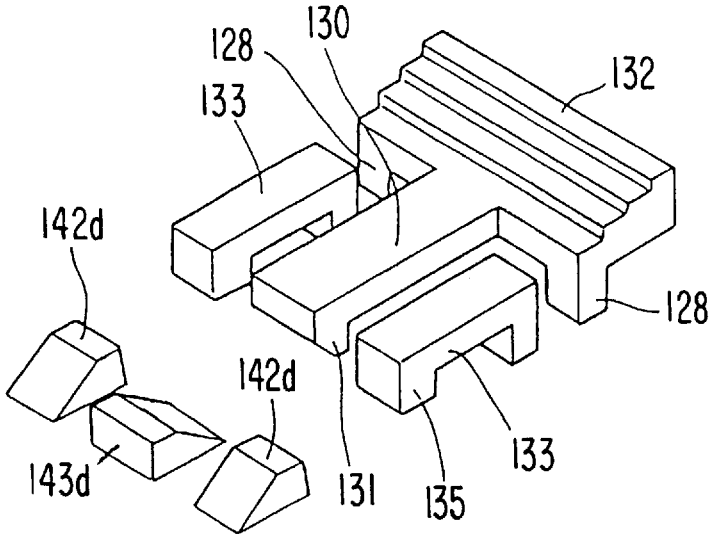
FIG. 18 is a diagonal view similar to FIG. 16 but shows another alternative arrangement.

FIG. 18 shows an arrangement in which two abutments 142*d* are provided on either side of projection 143*d*, the arms 133 and 13D being arranged accordingly with long and short lever arms about respective fulcrums.

Figure 19:
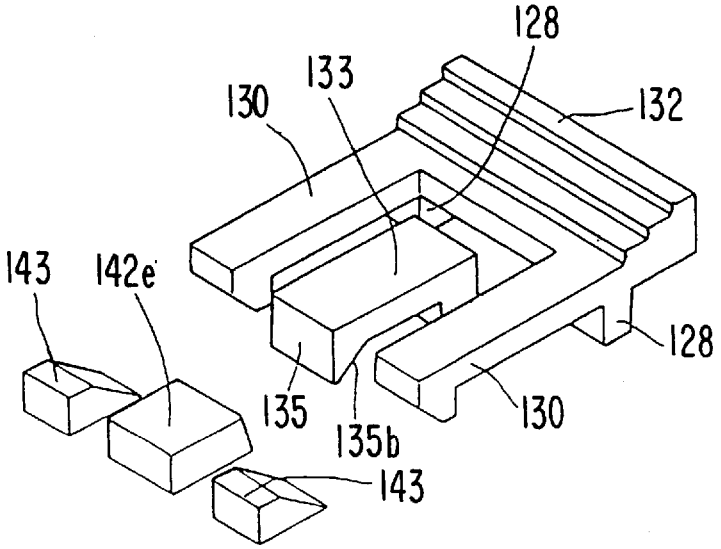
FIG. 19 is a diagonal view similar to FIG. 16 showing another arrangement.

FIG. 19 is similar to the embodiment of FIG. 16 but the abutment 142*e* has no angled ramp to ease disengagement. This ramp 135*b* is instead provided on the underside of arm 133 as illustrated.

Figure 20:
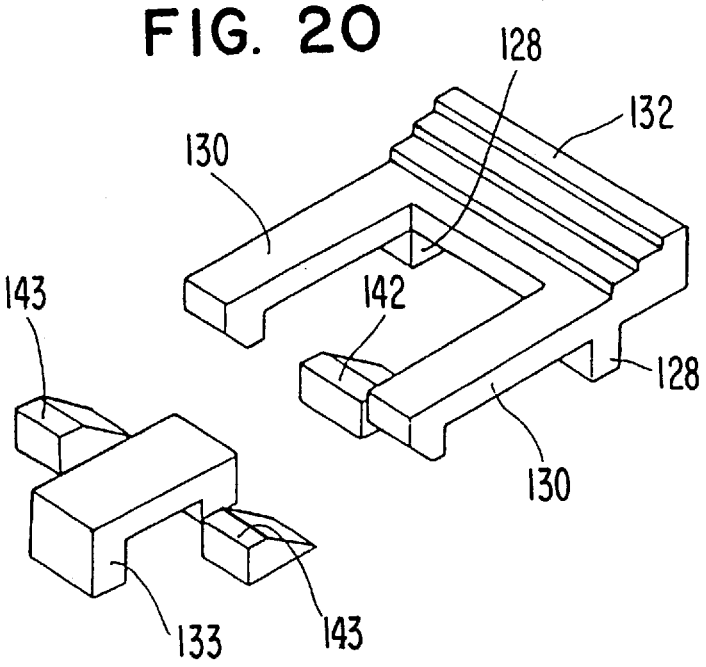
FIG. 20 is a diagonal view similar to FIG. 16 showing yet another arrangement.

FIG. 20 shows the arms 130 being provided on one connector whilst the arm 133 is provided on the other connector, the abutment 142 and projections 143 being arranged accordingly.

A third embodiment of the present invention is explained hereinbelow, with reference to FIGS. 21 to 25.

Figure 21:
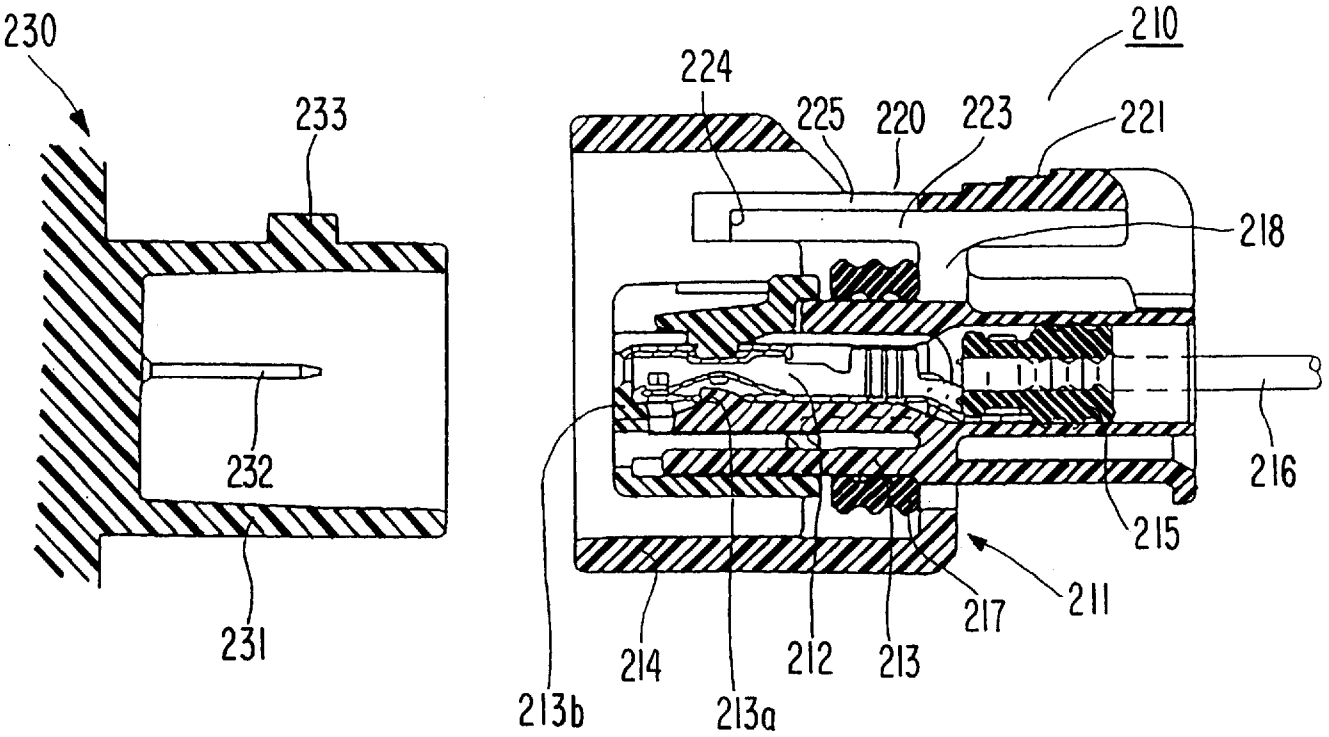
FIG. 21 is a vertical cross-section through male and female connectors constituting a third embodiment of the present invention.

A female connector 210 of the present embodiment is shown on the right side of FIG. 21. The connectors 210 and 230 are similar to the first and second embodiments.

The male connector 230 is illustrated as being formed uniformly onto a housing of an electrical appliance such as a relay (not shown). When the connectors 210 and 230 are correctly fitted together, the female terminal fitting 212 and the male terminal fitting 232 are electrically connected and are latched in a fitted state by means of a locking means, to be described next.

The male connector 230 has a short square pillar shaped fitting projection 233 formed on the upper face of the connector housing 231. On the upper face of the terminal insertion chamber 213 of the female connector 210 a locking arm 220 is provided on a supporting foot 218 so as to extend in the fitting direction of the connectors 210 and 230. A pressing member 221, shaped so as to prevent slipping, is formed in the posterior end (the right side in FIG. 21) of the locking arm 220. By operating this pressing member 221, the locking arm 220 can be made to change shape in the right-downward direction. A partitioning slit 222 is formed in the fitting direction along the centre of the locking arm 220 towards a side anterior to the supporting foot 218. (FIG. 25) Consequently, the locking arm 220 is partitioned into left and right members. Each partitioned member has a main arm member 223 that extends from the supporting foot 218 towards the anterior end, and a fitting member 224 provided at the anterior end of the main arm member 223 and extending sideways. An eaves-shaped extension member 225 is formed on each main arm member 223 so as to extend up to the anterior end of the fitting member 224. Moreover, the fitting members 224 on the left and right extend so as to mutually approach each other. Consequently, the sides of the partitioning slit 222 form a scooped-out space, excluding the fitting members 224.

Figure 26:
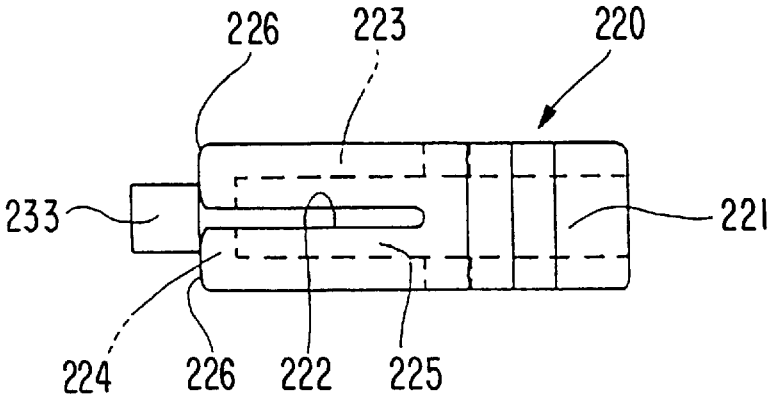
FIG. 26 is a plan view showing the initial engagement of the locking arm and the fitting projection of the third embodiment.

The partitioning slit 222 corresponds to the centre of the fitting projection 233 of the male connector 230, and the fitting projection 233 is located in a position so as to be insertable into the partitioning slit 222. As shown in FIG. 26, inclined guiding faces 226 are formed in the anterior part of the locking arm 220. With the partitioning slit 222 as centre, the inclined guiding faces 226 widen slightly as they approach the anterior end of the locking arm 220.

Figure 22:
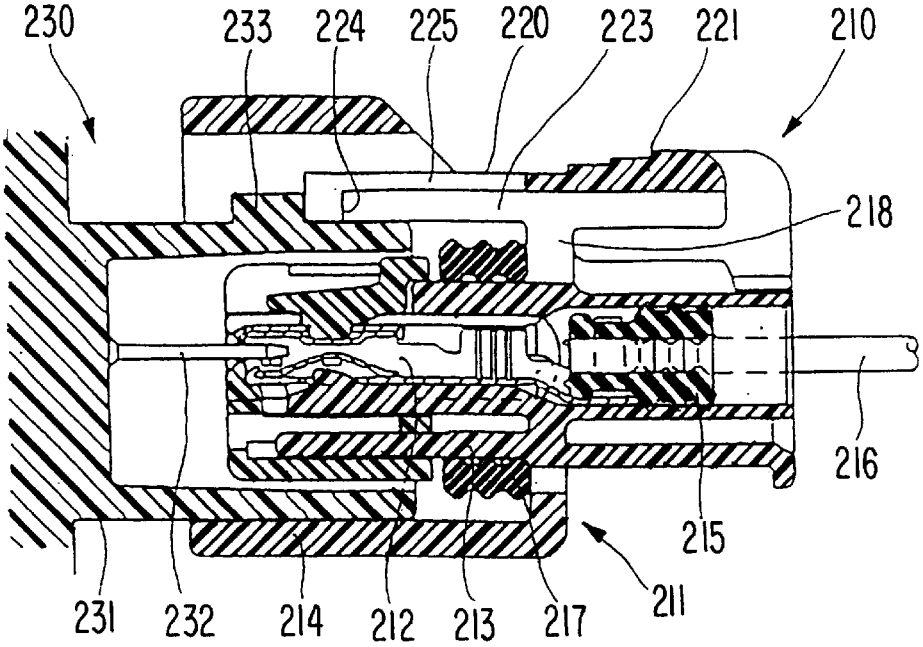
FIG. 22 is a vertical cross-section showing the fitting process of the third embodiment.
Figure 23:
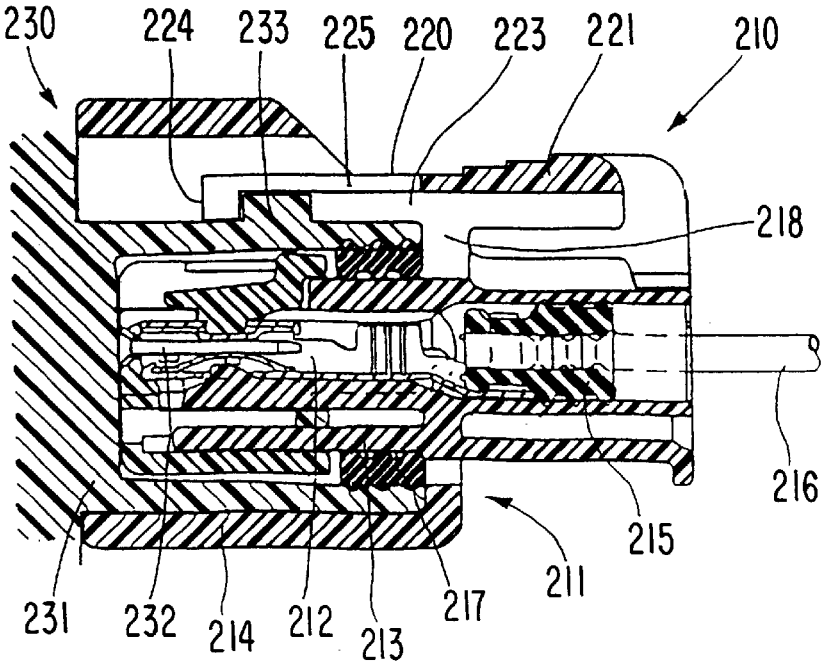
FIG. 23 is a vertical cross-section showing the filled state of the third embodiment.
Figure 27:
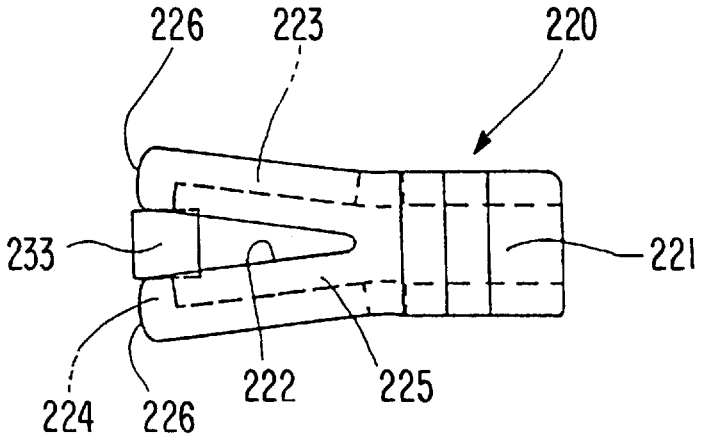
FIG. 27 is a plan view showing the fitting process of the locking arm and the fitting projection of the third embodiment.
Figure 28:
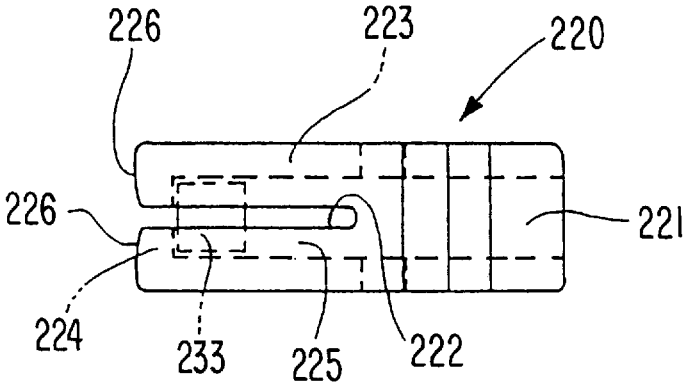
FIG. 28 is a plan view showing the end of the fitting process of the third embodiment.

When the female connector 210 is fitted with the male connector 230, the terminal insertion member 213 enters the connector housing 231 of the male connector 230, and when the fitting is half-complete, the anterior ends of the fitting member 224 of the locking arm 220 strike against the fitting projection 233 (see FIGS. 22 and 26). Since the anterior part of the locking arm 220 has inclined guiding faces 226 widening anteriorly, each main arm member 223 of the locking arm 220 is pushed sideways along the inclined guiding face 226 and the fitting projection 233 is inserted into the partitioning slit 222 (see FIG. 27). When the two connectors 210 and 230 are in the correctly fitted position, the posterior ends of the fitting members 224 reach a position where they ride over the fitting projection 233. As a result, the main arm members 223 resiliently revert to their original position, and, as shown in FIG. 28, the locking arm 220 is stopped by the fitting projection 233 since the fitting members 224 surround the posterior side of the fitting projection 233.

During the fitting process of the connectors, the fitting members 224 collide against the fitting projection 233. The main arm members 223 resiliently change shape in order to avoid the fitting projection 233 and consequently provide the fitting resistance of the connector. As the fitting proceeds, the fitting resistance increases suddenly, and as the correct fitting position is approached, the fitting resistance disappears suddenly. This provides a close fit. Moreover, when the connectors 210 and 230 reach the locked position in this manner, the male terminal fitting 232 is inserted completely into the female terminal fitting 212 and a correct fitted connected state is established (see FIG. 23).

Figure 24:
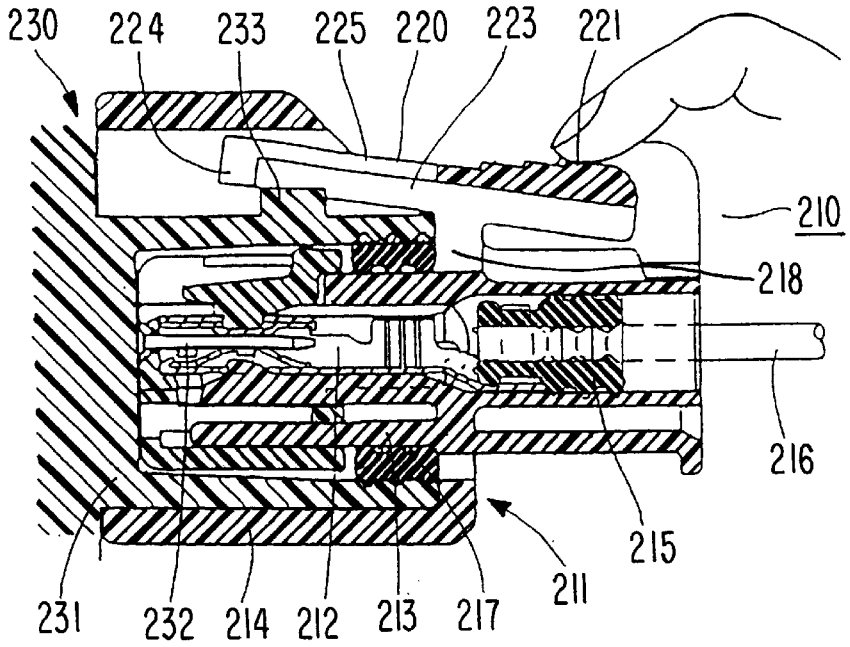
FIG. 24 is a vertical cross-section showing the release of the male and female connectors of the third embodiment.
Figure 25:
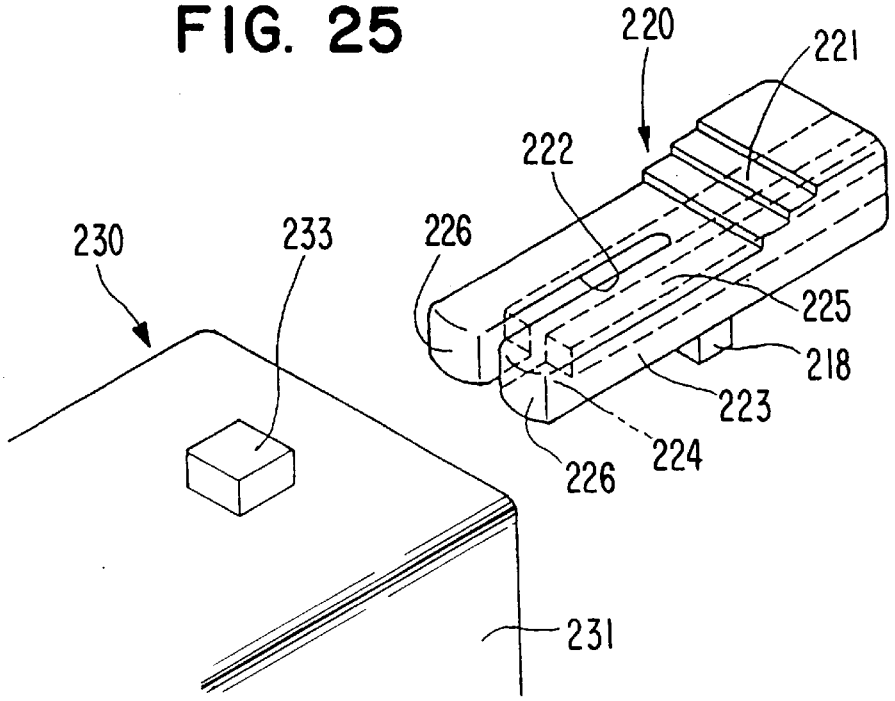
FIG. 25 is a diagonal view of the locking arm and the fitting projection of the third embodiment.

When the connectors 210 and 230 have to be separated, as shown in FIG. 24, the pressing member 221 of the locking arm 220 is pressed down using a finger or thumb. When this is done, the main arm members 223 of the locking arm 220 resiliently change shape so that their anterior ends, constituting the fitting members 224, are raised upwards with the supporting foot 218 as axis. For this reason, the anterior end of the locking arm 220 is raised only to the extent of the height of the fitting projection 233, and the fitting of the fitting members 224 and the fitting projection 233 is released. At this juncture, if the female connector 210 is pulled away from the male connector 230, the female connector 210 can be removed from the interior of the connector housing 231 of the male connector 230.

In this way, according to the third embodiment, when both the connectors 210 and 230 are fitted together, the fitting members 224 of the locking arm 220 make contact with the fitting projection 233, and the fitting resistance is produced when the main arm members 223 change shape sideways to evade the fitting projection 233. This produces a close fit. Consequently, in the case where a strong closeness of fit is desired, if the width-wise dimensions of the main arm members 223 are set to be wide, the strength thereof increases correspondingly. In this way, a strong fit is achieved.

Moreover, in this case, since the fitting members 224 project sideways from the main arm members 223, if the width-wise dimension of each main arm member 223 is set to be large, the projecting length of the fitting member 224 is added thereto, resulting in a larger width-wise dimension of the locking arm 220. Consequently, there is cause for worry that the connector becomes large. However, taking this point into consideration, in the present embodiment, an extension member 225 is provided that extends eaves-like up to the anterior end of the fitting member 224 in each main arm member 223. Consequently, by ensuring that the width-wise dimension does not extend beyond the projecting dimension of the fitting member 224, the strength of the main arm member 223 can be increased by means of this extension member 225. As a result, since the fitting member 224 never projects beyond the extension member 225, the locking arm 220 as a whole becomes more compact and miniaturization of the connector as a whole can be effected.

When the latch is released, since the fitting is released by raising the anterior end of the locking arm 220 upwards so that the locking arm 220 changes shape in a vertical direction, the locking arm 220 needs to be made to change shape only to the extent of the height of the fitting projection 233. Consequently, even if the closeness of fit is strengthened by increasing the strength of the main arm member 223 in the width-wise direction, the elasticity of the locking arm 220 in the vertical direction is not adversely affected. As a result, deterioration in the locking release operation can be prevented with certainty.

Furthermore, and particularly in the third embodiment, since the configuration is such as to provide the partitioning slit 222 in the centre of the locking arm 220 and inserting the fitting projections 233 into it, the force produced when the main arm member 223 elastically change shape sideways is borne by the two main arm members 223 and the extension members 225 which are separated by the partitioning slit 222. As a result, the force borne by each decreases, and the restrictions on shape and thickness are reduced. This has the effect of increasing the degree of design freedom. Moreover, since the fitting projection 233 has a configuration whereby the fitting projection 233 makes contact with the centre of the locking arm 220, the balance in the left and right directions is good, and the fitting operability of the connectors improves.

Moreover, in the present embodiment, since the inclined guiding faces 226 are formed on the anterior end of the locking arm 220, the fitting projection 233 can have a simple square shape. This means that the moulding of the male connector housing 231 becomes simple. Accordingly, it is useful in the case of unified male connectors 230 where the use of glass fibre strengthened resin results in a deterioration in the mould.

The present invention is not limited to the embodiments described above with the aid of figures. For example, the possibilities described below also lie within the technical range of the present invention. Moreover, the present invention may be embodied in various ways other than those described below without deviating from the scope thereof.

(1) In the first embodiment, although collision-preventing projections 34 have been located on two sides with the fitting projections 33 in the centre, the invention is not limited to this layout and, as illustrated for example in FIG. 10.

(2) In the first embodiment, although the locking arm 20 has been positioned to be on the upper face of the terminal insertion chamber 13 of the female connector 10, the invention is not limited to this layout. In the case where the terminal insertion chamber 13 of the female connector 10 is arranged to be covered by a hood member, it can be equally arranged so that the locking arm hangs down from the hood member via a supporting member.

Figure 29:
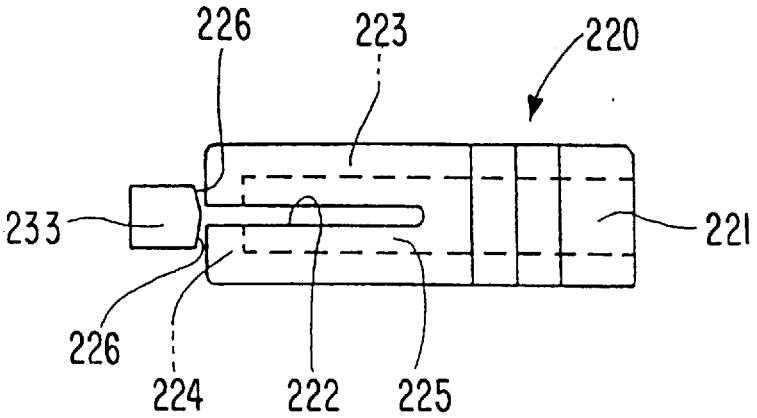
FIG. 29 is a plan view showing a locking arm and a fitting projection of a variation on the third embodiment.
Figure 30:
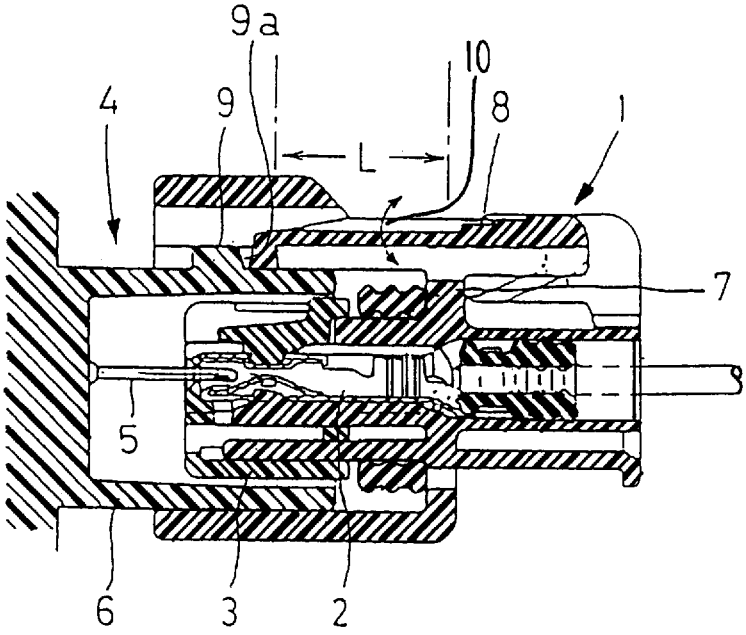
FIG. 30 PRIOR ART
FIG. 30 is a cross-section of the fitting process of a conventional male connector and female connector.
Figure 31:
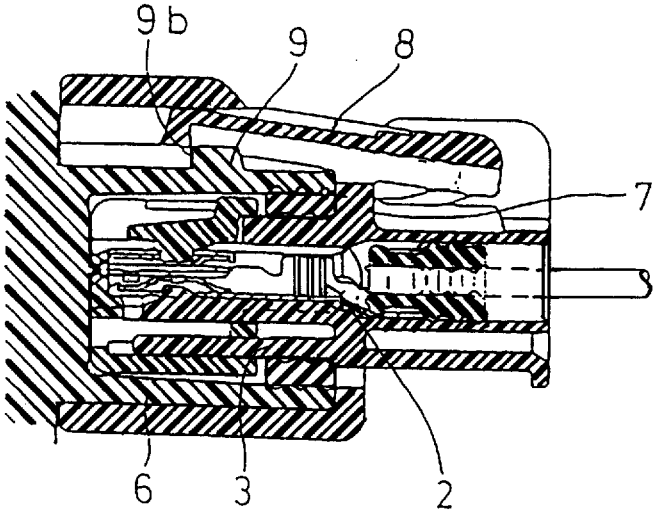
FIG. 31 PRIOR ART
FIG. 31 is a cross-section of the fitting process of a conventional male connector and female connector.
Figure 32:
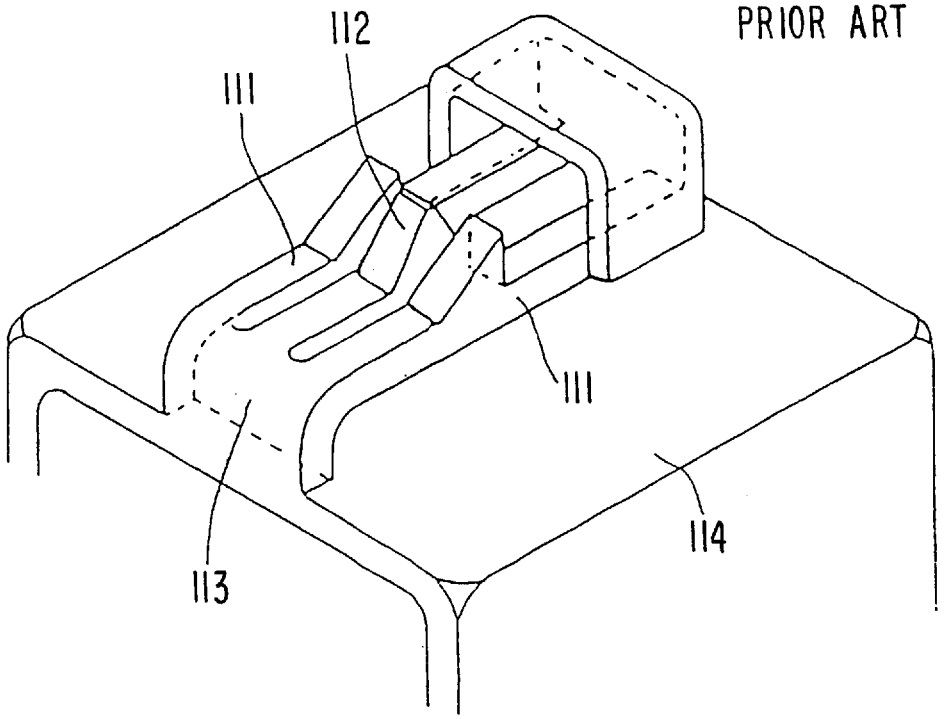
FIG. 32 PRIOR ART
FIG. 32 is a diagonal view of another conventional male connector.

(2) Although in the third embodiment, inclined guiding faces 226 were formed on the anterior end of the locking arm 220, as shown in FIG. 29, it may equally be arranged so that inclined guiding faces 226 are formed on the fitting projection 233 towards the side of the locking arm 220.

(3) Further, although not shown in a diagram, in the third embodiment of the invention it is not necessary to provide a partitioning slit in the locking arm. The elastically moving arm member can equally be one in number, as long as the configuration is such as to make the locking arm move sideways with respect to the fitting projection and such as to make the fitting member of the locking arm move over the upper part of the fitting projection for releasing the fitting.

We claim:

1. A connector assembly comprising a female connector and a male connector for insertion in said female connector, wherein one of the male and female connectors has a latching arm and the other of the male and female connectors has a latching abutment for engagement by the latching arm, the latching arm and latching abutment having a latching force, and the latching arm engaging the latching abutment to releasably retain the male connector in the female connector, the assembly further including insertion resistance means on the male and female connectors, in use the insertion resistance means being effective only in the insertion direction to increase said latching force.

2. An assembly according to claim 1 wherein said insertion resistance means comprises a resilient insertion arm of one of said connectors and an insertion abutment of the other of said connectors.

3. The assembly of claim 2 wherein on engagement of the insertion arm with the insertion abutment, the insertion arm is deflected resiliently, thereby imparting resistance to insertion of the male connector into the female connector.

4. The assembly of claim 2 comprising two latching arms and an insertion arm, or two insertion arms and a latching arm, the two arms being either side of the one arm.

5. The assembly of claim 2 wherein said insertion arm is stiffer than said latching arm.

6. The assembly of claim 5 wherein said insertion arm is shorter than said latching arm.

7. The assembly of claim 6 wherein said insertion arm and said latching arm are each mounted on a connector by a respective foot.

8. The assembly of claim 7 wherein said insertion arm and said latching arm are mounted on the same connector.

9. The assembly of claim 8 wherein the foot of said latching arm is adjacent the foot of said insertion arm.

10. The assembly of claim 9 wherein the said insertion arm and said latching arm have a common foot.

11. The assembly of claim 10 wherein said insertion arm forms part of said latching arm.

12. The assembly of claim 7 wherein the latching arm extends on either side of the respective foot, the foot being a fulcrum, one end of the latching arm being for engagement with the latching abutment, and the other end having a contact surface arranged such that on the application of pressure thereto, the latching arm bends about said foot to disengage said latching abutment.

13. The assembly of claim 2 wherein the insertion arm is the latching arm.

14. The assembly of claim 13 wherein the latching arm is mounted on a foot.

15. The assembly of claim 14 wherein the latching arm extends on either side of the foot, the foot being a fulcrum, one end of the latching arm being for engagement with the latching abutment, and the other end having a contact surface arranged such that on the application of pressure thereto, the latching arm bends about said foot to disengage said latching abutment.

16. The assembly of claim 14 wherein the latching arm comprises a latching face for engagement with the latching abutment, and an insertion face for engagement with the insertion abutment.

17. The assembly of claim 16 wherein the insertion face is nearer the foot than is the latching face.

18. The assembly of claim 16 comprising two insertion faces, the insertion faces being either side of the latching face.

19. The assembly of claim 13 wherein the latching arm is arranged to be deflected resiliently in a first plane in the insertion direction of the connectors, and in a second plane for disengagement of the connectors, the stiffness of the latching arm in the first plane being greater than that in the second plane.

20. The assembly of claim 19 wherein the first and second planes are mutually perpendicular.

21. The assembly of claim 19 wherein the latching arm has a forked end arranged to be deflected apart in the first plane on insertion of the connectors.

* * * * *